US005645473A

United States Patent [19]

Togawa et al.

[11] Patent Number: 5,645,473

[45] Date of Patent: Jul. 8, 1997

[54] POLISHING APPARATUS

[75] Inventors: Tetsuji Togawa, Fujisawa; Toyomi Nishi, Yokohama, both of Japan

[73] Assignee: Ebara Corporation, Tokyo, Japan

[21] Appl. No.: 621,790

[22] Filed: Mar. 28, 1996

[30] Foreign Application Priority Data

Mar. 28, 1995 [JP] Japan ..... 7-094535

[51] Int. Cl.[6] ..... B24B 5/00; B24B 29/00

[52] U.S. Cl. ..... 451/287; 451/288; 451/289; 451/390; 451/398; 451/384

[58] Field of Search ..... 451/287–289, 451/384, 390, 397, 398, 41, 42, 451, 334

[56] References Cited

U.S. PATENT DOCUMENTS 4,450,652 5/1984 Walsh ..... 451/288
5,317,837 6/1994 Stahli ..... 451/287
5,421,769 6/1995 Schultz et al. ..... 451/287
5,456,627 10/1995 Jackson et al. ..... 451/63
5,486,265 1/1996 Salugsugan ..... 451/287
5,536,202 7/1996 Appel et al. ..... 451/287
5,542,874 8/1996 Chikaki ..... 451/289

*Primary Examiner*—Robert A. Rose
*Assistant Examiner*—George Nguyen
*Attorney, Agent, or Firm*—Wenderoth, Lind & Ponack

[57] ABSTRACT

A polishing apparatus for polishing a workpiece such as a semiconductor wafer has a reduced height compared with conventional polishing apparatuses. The height reduction is achieved by disposing a drive motor for rotating a top ring below a turntable, and by making a swing shaft for loading/unloading of the workpiece hollow to accommodate a rotating shaft for transmitting rotation from the motor to the top ring.

9 Claims, 4 Drawing Sheets

POLISHING APPARATUS

BACKGROUND OF THE INVENTION

1. Field of the Invention

The present invention relates to a polishing apparatus, and more particularly to a polishing apparatus for polishing a workpiece such as a semiconductor wafer to a flat and mirror polished surface.

2. Description of the Related Art

Recent rapid progress in semiconductor device integration demands smaller and smaller wiring patterns or interconnections and also narrower spaces between interconnections with connect active areas. One of the processes available for forming such interconnection is photolithography. Although the photolithographic process can form interconnections that are at most 0.5 μm wide, it requires that surfaces on which pattern images are to be focused on by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Such a polishing apparatus has a turntable and a top ring which rotate at respective individual speeds. An abrasive cloth is mounted on the upper surface of the turntable. A workpiece such as a semiconductor wafer to be polished is placed on the abrasive cloth and clamped between the top ring and the turntable. During operation, the top ring exerts a constant pressure on the turntable, and an abrasive solution is supplied from a nozzle over the abrasive cloth. The abrasive solution enters the gap between the abrasive cloth and the workpiece. The surface of the workpiece held against the abrasive cloth is therefore polished while the top ring and the turntable are rotating.

One known polishing apparatus of the above-described type is disclosed in, for example, Japanese Patent Publication No. 62-46308. The polishing apparatus has a turntable with an abrasive cloth mounted thereon and is supported by a vertical shaft below the turntable, and the shaft is driven by a driving mechanism. A top ring holding a wafer to be polished is positioned above the turntable, and the wafer is pressed against the abrasive cloth by the vertical moving mechanism of the top ring. The pressing force against the wafer is provided by a pneumatic cylinder of the vertical moving mechanism. Also, Japanese Laid-open Patent Publication No. 6-99348 discloses another structure of a polishing apparatus.

FIG. 4 shows an example of a structure of a conventional polishing apparatus including a turntable 1 having an abrasive cloth mounted thereon, a turntable driving mechanism (not shown) for rotating the turntable 1 about the turntable support axis, a top ring 2 which holds a wafer to be polished and is positioned above the polishing position of the turntable 1, a top ring rotating mechanism which rotates a top ring shaft 21 via a top ring support member 16, and a top ring pressing mechanism 14 for pressing the top ring 2 holding the wafer against the turntable 1.

The top ring 2 is provided with shaft 21 extending upwards from the center of the top ring 2, and this shaft 21 is driven to rotate by means of a belt 13 which is coupled to a motor 6 disposed on the support member 16 which holds the top ring 2 in place. The support member 16 is provided with a cylinder forming mechanism 14 for providing a vertical movement of the top ring 2 so as to press down the top ring 2 onto the turntable 1 and a counterweight 17. There is also a mechanism for swinging the top ring 2 away from the turntable 1 for loading/unloading of a wafer. The support member 16 holding the top ring 2 is made to swing by rotating drive shaft 4 by means of gears 8, 9 driven by a motor 7. Bearing 22 disposed on the stationary base 3 freely rotatably supports the shaft 4. Therefore, the top ring 2 cannot only rotate about the shaft 21, but can also swing about the swing shaft 4.

As shown in FIG. 4, the conventional polishing apparatus described above has the top ring swing mechanism (motor 7) positioned below the turntable, however the top ring rotation mechanism (motor 6) is positioned above the turntable, and the top ring rotation mechanism and the top ring pressing mechanism also are positioned well above the top ring. The result is that the overall height of the polishing apparatus becomes large, leading to problems such as a difficulty of installing the polishing apparatus into a cleanroom. Furthermore, dust particles generated by the motor 6 are prone to fall on the turntable 1 to cause wafer quality problems, and mist scattered from an abrasive solution on the abrasive cloth often causes malfunctioning of the motor 6.

SUMMARY OF THE INVENTION

It is therefore an object of the present invention to provide a polishing apparatus having a compact design to facilitate transportation, installation, and handling of the polishing apparatus, for example, to enable the polishing apparatus easily to be installed in a narrow cleanroom, as well as to improve the yield of polished wafers.

According to the present invention, there is provided a polishing apparatus including a turntable that may have an abrasive cloth at an upper surface thereof, the abrasive cloth being supplied with an abrasive solution thereon, a top ring positioned above the turntable for holding a workpiece to be polished and pressing the workpiece against the abrasive cloth, a first motor positioned below the turntable for rotating the top ring, a second motor positioned below the turntable for swinging the top ring for loading/unloading of the workpiece, a hollow shaft connected to the second motor for swinging the top ring, and a rotation shaft positioned within the hollow shaft, the rotation shaft being connected to the top ring and to the first motor for rotating the top ring.

By positioning the first motor below the turntable, utilizing a hollow shaft for the swinging mechanism for swinging the top ring, and positioning a shaft for rotating the top ring within the hollow shaft, it becomes possible to reduce the overall height of the apparatus. Further, dust particles generated by the rotating first motor are not dropped onto the surface of the abrasive cloth or the turntable, thereby eliminating wafer quality problems. Further, malfunctioning of such first motor caused by mist scattered from the abrasive solution also is prevented.

Another aspect of the polishing apparatus is that an eccentricity-compensating coupling is positioned between the rotation shaft and a pulley means. By positioning the eccentricity-compensating coupling in such location, the driving force of the first motor can be accurately transmitted to the pulley means while absorbing eccentric motion between the rotation shaft and the pulley means.

Another aspect of the polishing apparatus is that a top ring pressing cylinder for exerting a pressing force onto the workpiece is positioned at an angle inclined to a vertical direction, thereby reducing overall height of the polishing apparatus.

Further, another aspect of the polishing apparatus is that a horizontal link is rotatably supported by a fulcrum and transmits raising/lowering movements to the top ring from the cylinder, thereby also reducing the overall height of the polishing apparatus.

The above and other objects, features, and advantages of the present invention will become apparent from the following description when taken in conjunction with the accompany drawing which illustrate preferred embodiments of the present invention by way of example. In the drawings, same or equivalent parts are referred to by the same reference numerals.

PREFERRED EMBODIMENTS OF THE INVENTION

Figure 1:
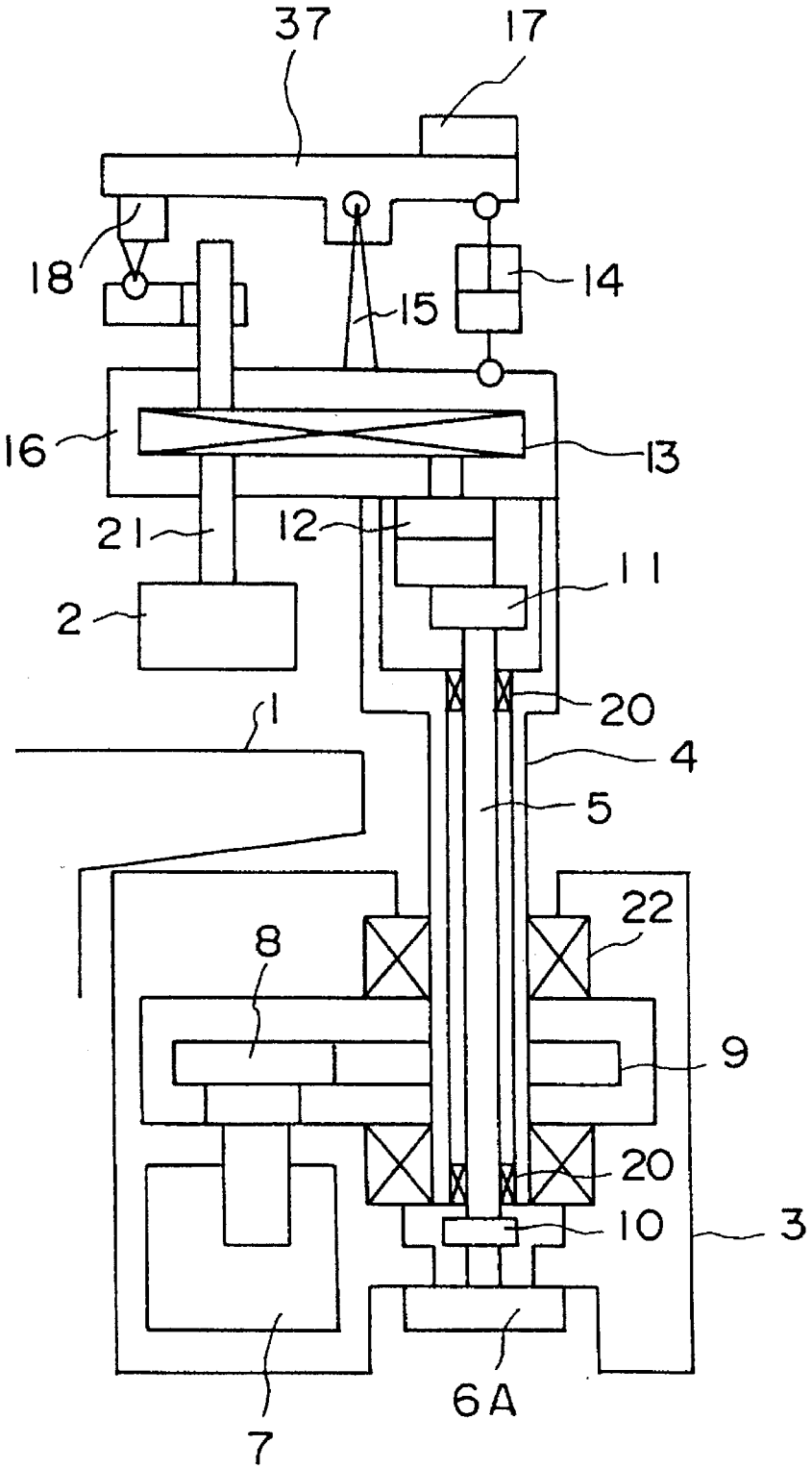
FIG. 1 is a schematic view of a main portion of a first embodiment of the polishing apparatus of the present invention.

FIG. 1 shows a first embodiment of the polishing apparatus. The turntable 1 and the drive mechanism for the turntable 1 are the same as those in the conventional polishing apparatus. The top ring 2 for holding the wafer and for pressing the wafer onto the abrasive cloth of the turntable is the same as that in the conventional polishing apparatus. Also, the top ring is rotated and pressed onto the turntable while an abrasive solution is applied onto the abrasive cloth for polishing the workpiece the same as in the convention polishing apparatus shown in FIG. 4.

In the first embodiment, the mechanism for rotating the top ring 2 includes a flat motor 6A, a shaft 5, an eccentricity-compensating coupling 11, a pulley means 12, a belt 13 and a driving shaft 21 of the top ring 2. The flat motor 6A for rotating the top ring 2 is positioned below the turntable 1. The shaft 5 is positioned within a hollow shaft 4, and the shaft 5 is supported by top and bottom bearings 20 in the hollow shaft 4. The shaft 5 is connected at one end via a coupling 10 to flat motor 6A, and is connected at the other end via eccentricity-compensating coupling 11 to pulley means 12. Rotation force of the shaft 5 driven by the motor 6A is transmitted to the top ring 2 via belt 13 and shaft 21.

The swinging mechanism for the top ring 2 includes the top ring support member 16 which rotatably supports the top ring 2 at one end and is fixed to the hollow shaft 4 at the other end. The top ring support member 16 is supported by the hollow shaft 4 for rotation therewith to swing the top ring 2 for loading/unloading of a wafer. Such swinging motion of member 16 and rotation of the hollow shaft 4 is achieved by AC servomotor 7 via gears 8, 9. The hollow shaft 4 is rotatably supported by bearings 22 fixed to stationary base 3. The top ring 2 is moved toward the turntable by a pressing mechanism including pressing cylinder 14 pushing against a counterweight 17. The cylinder 14 is attached to one end of a link 37 which is rotatably supported by a base section 15 so that the opposite end of the link 37 moves downward to cause the top ring 2 to press down onto the turntable 1. The counterweight 17 is about the same weight as the top ring 2, and provides a balancing force so that the top ring 2 will not move downward when the pressing cylinder 14 is inactive.

Figure 4:
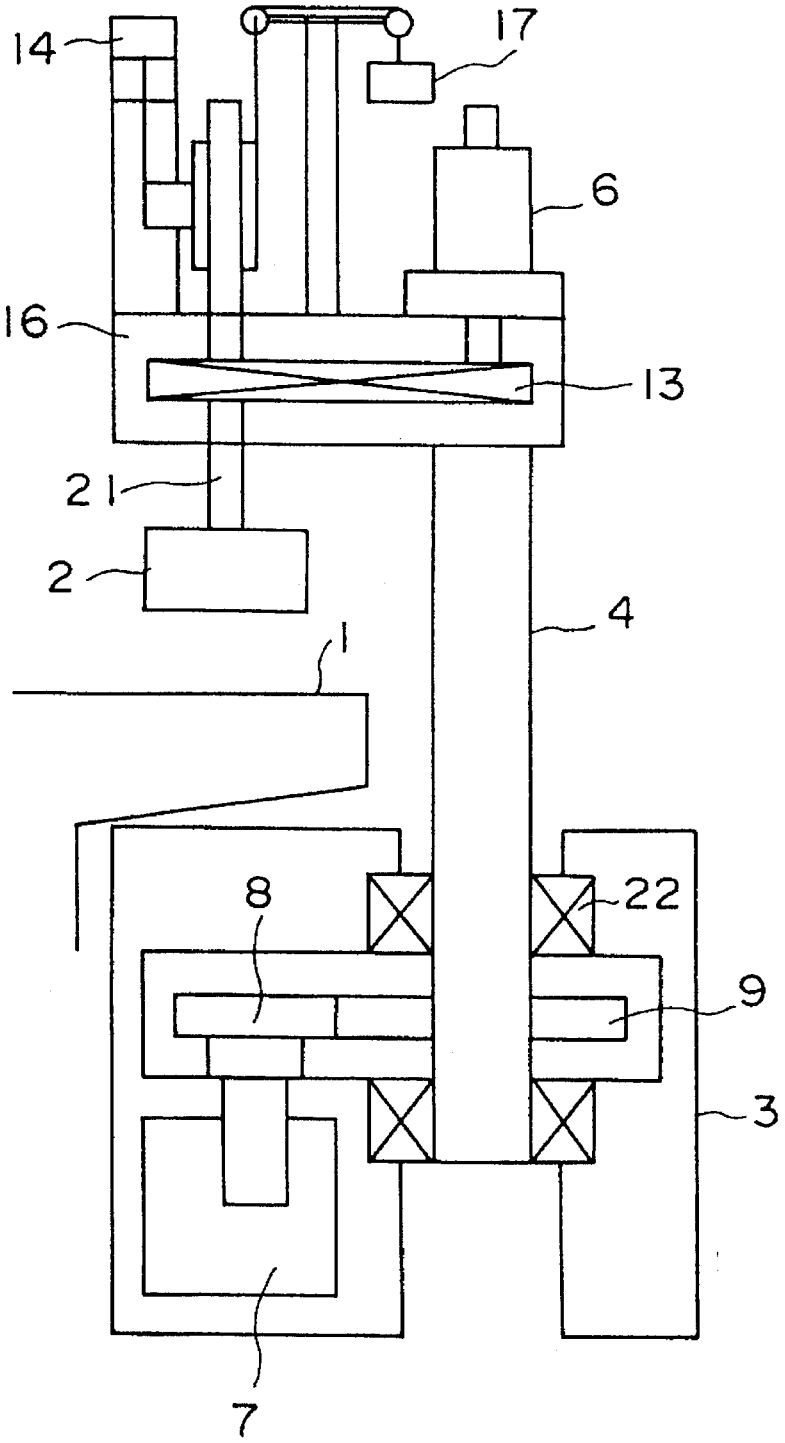
FIG. 4 (PRIOR ART)
FIG. 4 is a schematic view of a main portion of a conventional polishing apparatus.

In the conventional design of the top ring pressing mechanism shown in FIG. 4, the extension of a cylinder rod of cylinder 14 is transmitted directly to a slide ring attached to the top ring 2 to cause the top ring 2 to press onto the turntable 1. In contrast, in the first embodiment shown in FIG. 1, extension and contraction of the cylinder rod of cylinder 14 is transmitted indirectly to the top ring 2 by means of the horizontal link 37 pivoting about the base section 15 to press or retract the top ring 2. This design of the pressing mechanism using a pivoting movement of the horizontal link 37 permits the overall height of the polishing apparatus to be reduced.

According to the conventional design, the transmission of rotating force to the top ring 2 is accomplished by a direct linking of the rotation shaft 21 of the top ring 2 with a timing belt 13 driven directly by the motor 6 on the support member 16. In contrast, in the first embodiment of the invention the flat motor 6A is positioned below the turntable 1 and rotates the shaft 5 within the hollow shaft 4, and shaft 5 rotates the pulley means 12 via the eccentricity-compensating coupling 11. The rotation force of pulley means 12 is transmitted by the timing belt 13 to cause the top ring 2 to rotate. The design of the rotation mechanism of the top ring 2 using the motor 6A positioned below the turntable 1 and the shaft 5 within the hollow shaft 4 successfully reduces the overall height of the polishing apparatus.

Figure 2:
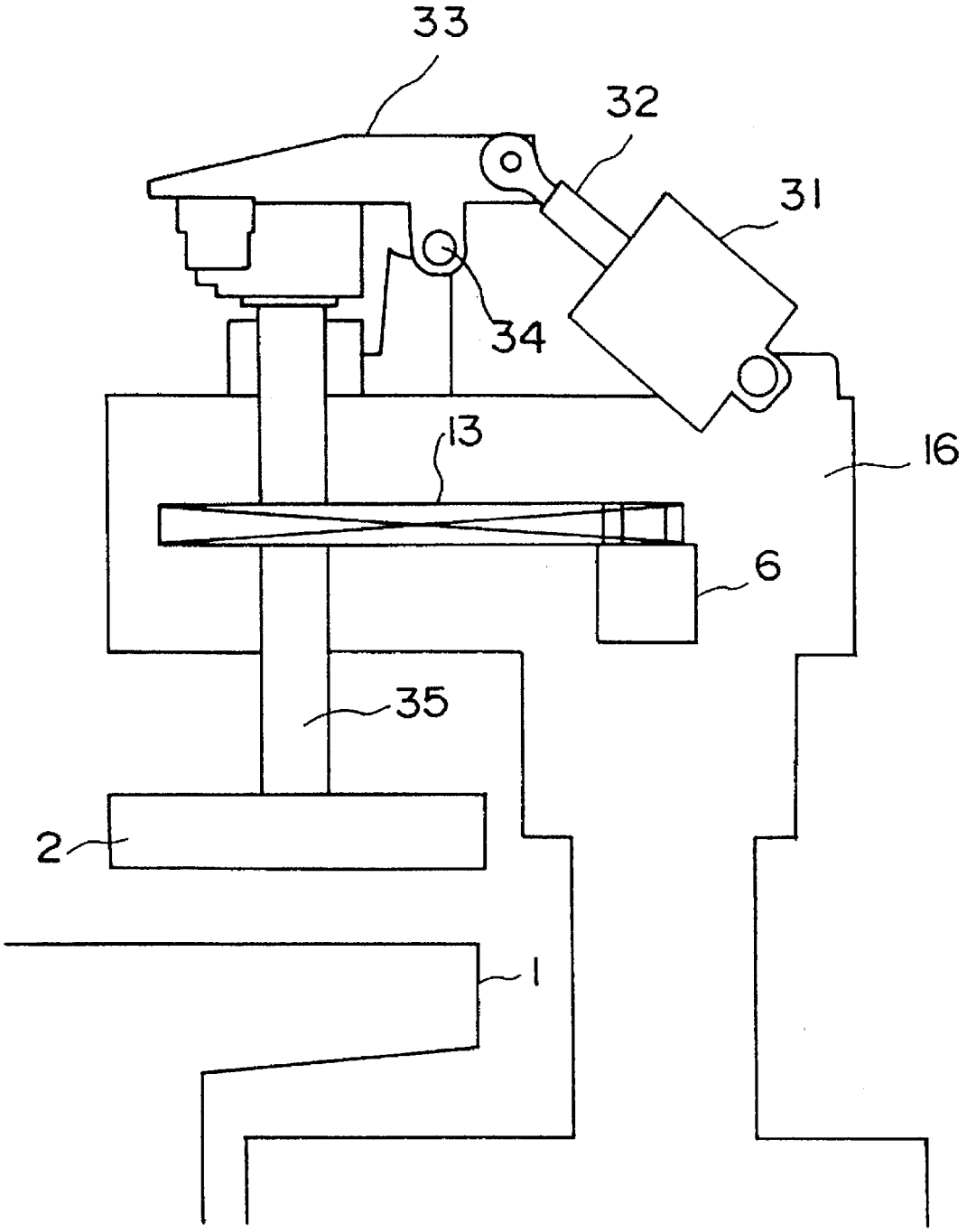
FIG. 2 is a schematic view of a main portion of a second embodiment of the polishing apparatus of the present invention.

FIG. 2 shows a second embodiment of the polishing apparatus. In this embodiment, a top ring pressing cylinder 31 is connected to the top ring indirectly and is positioned to operate at an angle inclined to the vertical. According to this arrangement shown in FIG. 2, extension/contraction movement of rod 32 of the cylinder 31 is transmitted to a horizontal link 33 which is rotatably supported by a fulcrum 4, thereby lowering or raising a rotation shaft 35 fixed to the top ring 2, thus providing pressing operation action of the top ring 2. This configuration further reduces the overall height of the polishing apparatus compared to the first embodiment polishing apparatus shown in FIG. 1. Further, the motor 6 for rotating the top ring 2 is housed in the support member 16.

Figure 3:
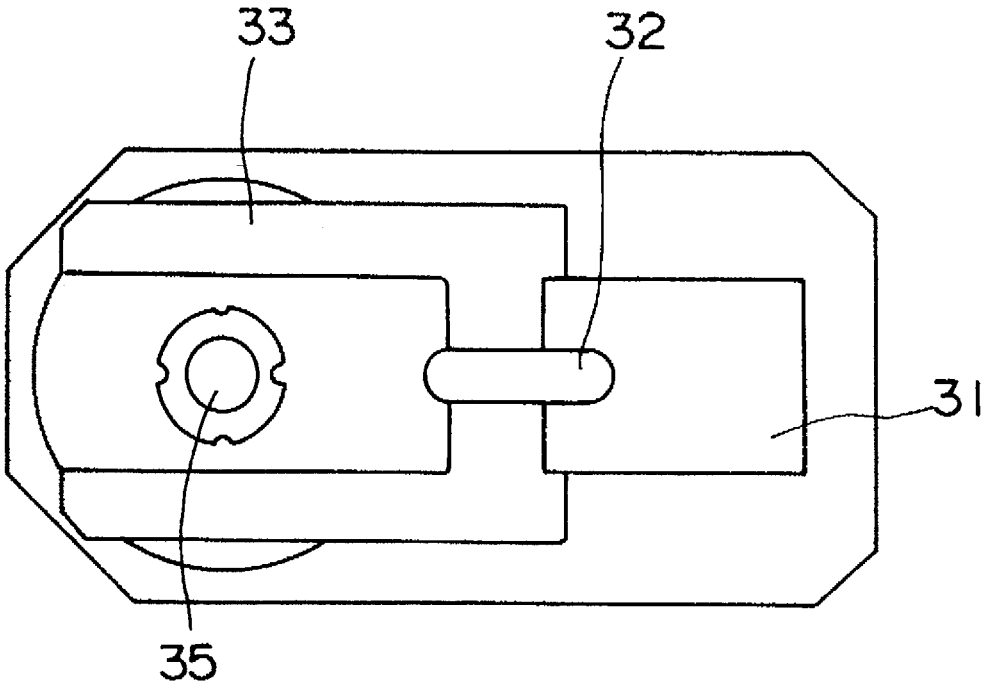
FIG. 3 is a top view of the polishing apparatus shown in FIG. 2.

FIG. 3 is a top view of the polishing apparatus shown in FIG. 2. The rod 32 of cylinder 31 seen on the right side of FIG. 3 is connected to yoke-shaped link 33, and the extension or contraction movement of the rod 32 causes the free end of the link 33 to rotate about the fulcrum 34 to cause the shaft 35 fixed to the top ring 2 to lower the top ring 2 to press a wafer or workpiece downwardly or to raise top ring 2.

It should be noted that, as in the case of the first embodiment, the motor 6A for rotating the top ring 2 may be placed below the turntable 1, and the swing shaft for swinging the support member 16 may be a hollow shaft having therein a shaft for transmitting rotation to the top ring.

The configuration of the polishing apparatus of the present invention achieves a reduction in the overall height of the polishing apparatus, thereby providing a much more compact and adaptable apparatus, compared with conventional polishing apparatuses. This facilitates transportation, installation, and handling of the apparatus, for example to install the apparatus in a narrow cleanroom.

Although certain preferred embodiments of the present invention have been shown and described in detail, it should be understood that various changes and modifications may be made thereto without departing from the scope of the appended claims.

What is claimed is:

1. A polishing apparatus for polishing a surface of a workpiece, said apparatus comprising:

a turntable;

a top ring positioned above said turntable for holding a workpiece to be polished and pressing the workpiece toward said turntable;

a first motor positioned below said turntable for rotating said top ring;

a second motor positioned below said turntable for swinging said top ring;

a hollow shaft connected to said second motor for swinging said top ring; and a rotation shaft positioned within said hollow shaft, said rotation shaft being connected to said top ring and to said first motor for rotating said top ring.

2. A polishing apparatus as claimed in claim 1, further comprising an eccentricity-compensating coupling, positioned between said rotation shaft and a pulley coupled with said top ring, for absorbing eccentric motion between said rotation shaft and said pulley.

3. A polishing apparatus as claimed in claim 1, further comprising an abrasive cloth on an upper surface of said turntable.

4. A polishing apparatus for polishing a surface of a workpiece, said apparatus comprising:

a turntable;

a top ring positioned above said turntable for holding a workpiece to be polished and pressing the workpiece toward said turntable;

a top ring pressing cylinder for moving said top ring to exert pressing force against the workpiece, said top ring pressing cylinder being mounted on a support member supporting a top ring driving shaft and having therein a top ring driving mechanism including a motor for rotating said top ring; and said top ring pressing cylinder being positioned at an angle inclined to a vertical direction, thereby reducing the overall height of said polishing apparatus.

5. A polishing apparatus as claimed in claim 4, further comprising an abrasive cloth on an upper surface of said turntable.

6. A polishing apparatus as claimed in claim 4, wherein said top ring pressing cylinder is rotatably fixed on said support member.

7. A polishing apparatus as claimed in claim 4, wherein said top ring driving mechanism further includes a pulley connected to said top ring driving shaft and a belt engaging said pulley and transmitting thereto rotation from said motor.

8. A polishing apparatus as claimed in claim 4, further comprising a link rotatably supported by a fulcrum on said support member, said link being connected to a rod of said top ring pressing cylinder and to said top ring driving shaft to thus transmit a pressing force against the workpiece.

9. A polishing apparatus as claimed in claim 8, wherein said link extends horizontally and is supported by said fulcrum, said link having first and second ends on opposite sides of said fulcrum, said first end being connected to said rod, and said second end being operable to move said top ring driving shaft.

* * * * *